United States Patent [19]

Shu

[11] 4,456,066

[45] Jun. 26, 1984

[54] VISBREAKING-ENHANCED THERMAL RECOVERY METHOD UTILIZING HIGH TEMPERATURE STEAM

[75] Inventor: Winston R. Shu, Dallas, Tex.

[73] Assignee: Mobil Oil Corporation, New York, N.Y.

[21] Appl. No.: 334,345

[22] Filed: Dec. 24, 1981

[51] Int. Cl.[3] ..... E21B 43/24

[52] U.S. Cl. ..... 166/272

[58] Field of Search ..... 166/272, 263, 303

[56] References Cited

U.S. PATENT DOCUMENTS

| | | | |
|---|---|---|---|
| 3,129,757 | 4/1964 | Sharp | 166/272 X |
| 3,259,186 | 7/1966 | Dietz | 166/272 X |
| 3,342,260 | 9/1967 | Lumpkin | 166/272 X |
| 3,354,954 | 11/1967 | Buxton | 166/272 |
| 3,357,487 | 12/1967 | Gilchrist et al. | 166/272 X |
| 3,439,741 | 4/1969 | Parker | 166/272 |
| 3,477,510 | 11/1969 | Spillette | 166/272 |
| 3,572,437 | 3/1971 | Marberry | 166/272 |

*Primary Examiner*—Stephen J. Novosad
*Attorney, Agent, or Firm*—Alexander J. McKillop; Michael G. Gilman; Lawrence O. Miller

[57] ABSTRACT

The displacement efficiency of a steam drive process is improved and steam override reduced by rapidly injecting a predetermined amount of high temperature steam via an injection well into the formation to visbreak a portion of the oil in the formation prior to a steam drive wherein steam is injected into the formation via the injection well to displace oil to a spaced-apart production well through which oil is recovered. The visbroken oil provides a more favorable transition of mobility ratio between the phases in the formation thereby reducing viscous fingering and increasing the displacement efficiency of the steam drive. In addition, after a predetermined amount of high temperature steam has been injected into the formation, the formation may be allowed to undergo a soak period prior to the steam drive. The high temperature steam injection and soaking steps may be sequentially repeated for a plurality of cycles.

7 Claims, 2 Drawing Figures

VISBREAKING-ENHANCED THERMAL RECOVERY METHOD UTILIZING HIGH TEMPERATURE STEAM

FIELD AND BACKGROUND OF THE INVENTION

1. Field of the Invention

This invention relates to the recovery of oil from a subterranean, viscous oil-containing formation and more particularly to an improved thermal recovery method involving the injection of a predetermined amount of high temperature steam into the formation prior to a steam drive process to improve displacement efficiency and enhance oil recovery.

2. Background of the Invention

In the recovery of oil from oil-containing formations, it usually is possible to recover only minor portions of the original oil in place by the so-called primary recovery methods which utilize only the natural forces present in the formation. Thus, a variety of supplemental recovery techniques have been employed in order to increase the recovery of oil from subterranean formations. One of the most widely used supplemental recovery techniques is the steam drive recovery process, which involves the injection of steam into the formation by means of an injection well and oil is recovered from the formation from a spaced-apart production well. As the steam moves through the formation, it not only serves as a driving force to cause the oil to flow into the producing well, but it gives up its heat to the oil thereby lowering the viscosity of the oil over a substantial portion of the formation, and enhancing the recovery of the oil.

In a steam drive recovery process, gravity overrides and viscous figuring are often experienced. Gravity overrides is associated with the fact that steam, being of lower density than other fluids present in the permeable formation, migrates to the upper portion of the permeable formation and channels across the top of the oil formation to the remotely located production well. Thus, steam override results in very little oil being recovered from the lower portions of the formation. Viscous fingering occurs when the displacing fluid comprising steam or condensed steam tends to finger through the oil phase towards the producing well, destroying piston-like displacement and resulting in premature breakthrough of the displacing fluid resulting in much of the oil being bypassed. Viscous fingering is dominantly caused by the large differences in oil and water viscosities resulting in a high water/oil mobility ratio which has an adverse effect on areal sweep efficiency or displacement efficiency of the displacing fluid. Most favorable mobility ratios and greater displacement efficiencies are therefore obtained when there is little difference between the viscosity of the displacement fluid and the oil.

U.S. Pat. No. 3,439,741 to Parker discloses a steam drive oil production process wherein slugs of heavy crude oil are periodically injected into the steam injection well with either continuous or intermittent injection of steam to upgrade the injected crude oil by visbreaking thereby reducing fingering and improving the production of oil. The temperature of the injected steam is at least 550° F., and is usually in the range of 550° to 650° F.

This invention reduces viscous fingering in a steam drive process by forming in-situ a zone of visbroken oil in the formation located between the in-place oil and the injected steam that provides a more favorable mobility ratio between the phases thereby improving the sweep efficiency of the steam drive.

SUMMARY OF THE INVENTION

The invention is a method for the recovery of viscous oil from a subterranean, viscous oil-containing formation in which a predetermined amount of high temperature steam is injected into the formation to visbreak a portion of the formation oil followed by steam flooding. The method involves rapidly injecting a predetermined amount of high temperature steam at a temperature of at least 500° F. into the formation via an injection well. The injected slug of high temperature steam condenses giving up its heat to the oil in the formation significantly cracking or visbreaking the oil on contact and creating a zone of visbroken oil located between the in-place viscous oil and the hot condensed steam or water front. Thereafter, steam at a temperature less than 500° F. is injected into the formation via the injection well and the in-place viscous oil and visbroken oil are driven through the formation toward a spaced apart production well from which fluids including oil are recovered. The zone of visbroken oil created by injection of the high temperature steam provides a more favorable transition of mobility ratio between the phases in the formation thereby reducing viscous fingering and increasing the displacement efficiency of the steam drive. In addition, the visbroken oil acts as a solvent on contact with the in-place viscous oil reducing its viscosity and further enhancing recovery of the viscous oil from the formation.

DESCRIPTION OF THE PREFERRED EMBODIMENTS

Figure 1:
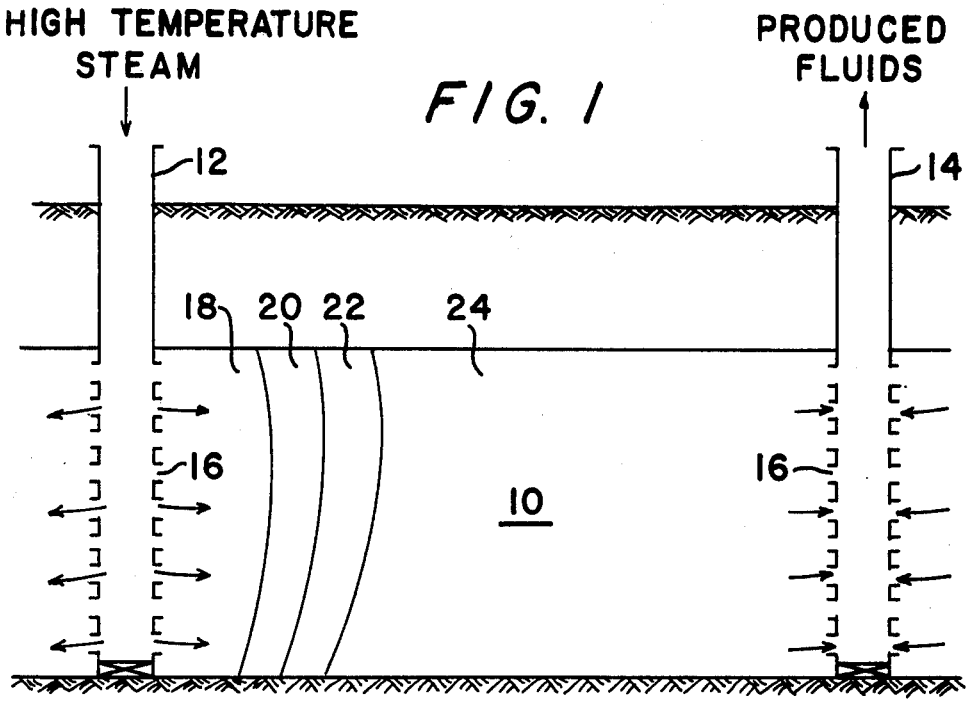
FIG. 1 shows a subterranean viscous oil-containing formation penetrated by an injection well and a production well illustrating the first step of my process in which a predetermined amount of high temperature steam is rapidly injected into the formation by means of the injection well to form a visbroken oil zone.
Figure 2:
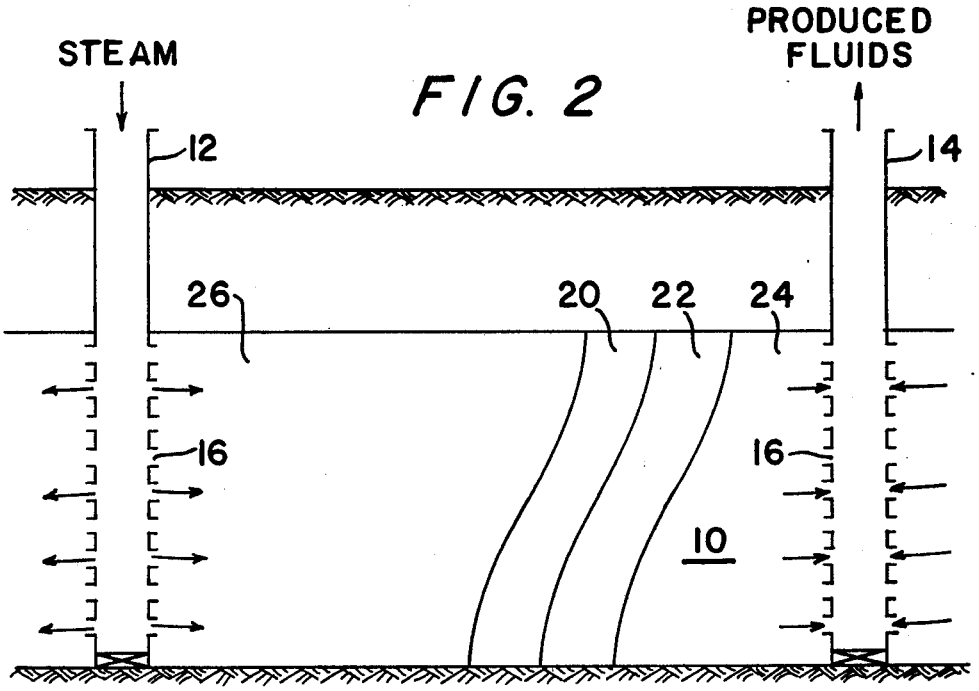
FIG. 2 illustrates the second step of my process in which the in-place oil and visbroken oil are driven through the formation by means of a steam drive and fluids including oil are recovered through a production well.

This invention is an improvement in a method for the thermal recovery of viscous oil in subterranean, viscous oil-containing formations utilizing steam at a temperature higher than what is used in a conventional steam operation followed by steam to displace the oil through the formation toward a production well for recovery. Referring to FIGS. 1 and 2, a formation 10 containing a viscous heavy oil, such as tar sand oil, is penetrated by an injection well 12 and a spaced-apart production well 14. Both wells 12 and 14 are in fluid communication with the formation through pre-selected perforations 16. Initially, a predetermined amount of high temperature steam is rapidly injected into the formation 10 via the injection well 12, preferably at the maximum allowable injection rate determined by the characteristics of the formation. The amount of high temperature steam injected is preferably not greater than 0.05 pore volume and the temperature of the injected steam is at least 500°

F. and preferably within the range of 500° to 700° F. The injected slug of high temperature steam invades the formation 10 and condenses therein giving up its heat to the viscous oil in the formation thereby thermally cracking or visbreaking the in-place oil which significantly reduces its viscosity. FIG. 1 represents a point in time immediately after the slug of high temperature steam has been injected into the formation wherein a high temperature steam zone 18 is created adjacent injection well 12; a hot water zone 20 formed from condensed steam adjacent zone 18; a visbroken oil zone 22 of formation oil reduced in viscosity adjacent zone 20 and an original viscous oil zone 24 located between production well 14 and zone 22.

Once the predetermined amount of high temperature steam has been injected into the formation, if desired, the injection well is shut-in and the formation allowed to undergo a brief soaking period for a variable time. The soaking period has the advantage of permitting the resulting heat of the injected steam to diffuse away from the injected well and induce maximum visbreaking of the oil in the formation. The length of the soaking period will vary depending upon the characteristics of the formation, particularly the viscosity of the oil contained therein.

Once the slug of high temperature steam has been injected into the formation, and after a soak period, if one is used, a heated driving fluid comprising steam is injected into the formation 10 via the injection well 12 to drive the in-place oil and visbroken oil through the formation toward production well 14 from which fluids including oil are recovered. The quality of the steam injected into the formation during this step may be within the range of 60 to 95% and the temperature of the injected steam is less than 500° F. for economic reasons, and preferably at temperatures in the range of 400° to 450° F. Steam injection is continued until the fluids including oil recovered from the formation via production well 14 contain an unfavorable amount of steam or water. FIG. 2 depicts the condition of the formation at a time well after steam drive and production has been initiated showing that the viscous oil zone 24 has decreased during this period due to the recovery of oil from this zone and the advanced position of the visbroken oil zone 22 and hot water zone 20 toward production well 14. The visbroken oil in zone 22 formed by the injection of high temperature steam during the first step of the process located between the viscous formation oil zone 24 and the hot water zone 20 provides a more favorable transition of mobility ratio between the phases thereby reducing viscous fingering and increasing the displacement efficiency of the recovery process. In addition, the visbroken oil acts as a solvent on the viscous oil in the formation to reduce its viscosity and further enhance recovery of the oil.

In a slightly different embodiment of the present invention, instead of injecting a single slug of high temperature steam in the formation according to the first step of the present method, a plurality of slugs of high temperature steam may be periodically injected into the formation with a soak period between each injection cycle so as to induce maximum visbreaking of the oil in the formation. The amount of high temperature steam injected during each injection cycle is preferably not more than 0.05 pore volume with the total amount of steam injected not to exceed 0.15 pore volume. The soak period after each injection cycle will vary depending upon the viscosity of the oil in the formation. Once the desired number of high temperature steam injection cycles followed by a soak period has been completed, the previously described steam drive is initiated and fluids including oil are recovered from the production well 14.

By the term "pore volume" as used herein, is meant that volume of the portion of the formation underlying the well pattern employed as described in greater detail in U.S. Pat. No. 3,927,716 to Burdyn et al, the disclosure of which is hereby incorporated by reference.

While the invention has been described in terms of a single injection well and a single spaced apart production well, the method according to the invention may be practiced using a variety of well patterns. Any other number of wells, which may be arranged according to any pattern, may be applied in using the present method as illustrated in U.S. Pat. No. 3,927,716 to Burdyn et al.

From the foregoing specification one skilled in the art can readily ascertain the essential features of this invention and without departing from the spirit and scope thereof can adapt it to various diverse applications. It is my intention and desire that my invention be limited only by those restrictions or limitations as are contained in the claims appended immediately hereinafter below.

What is claimed is:

1. A method of recovering viscous oil from a subterranean, viscous oil-containing formation including tar sands penetrated by at least one injection well and a spaced-apart production well, comprising:

(a) injecting high temperature steam at the maximum allowable injection rate in an amount not greater than 0.05 pore volume into the formation to visbreak a portion of the oil contained in the formation;

(b) injecting saturated steam into the formation to drive in-place oil and the visbroken oil through the formation toward the production well, said visbroken oil decreasing fingering of said steam; and (c) recovering fluids including oil from the formation via the production well.

2. The method of claim 1 wherein the temperature of the steam injected during step (a) is at least 500° F.

3. The method of claim 1 wherein the temperature of the steam injection during step (a) is within the range of 500° to 700° F.

4. The method of claim 1 wherein the quality of steam injected during step (b) is within a range of from 60 to 95 percent and the temperature is less than 500° F.

5. The method of claim 1 further comprising the step of shutting-in the injection well and allowing the formation to undergo a soak period of variable time after step (a).

6. The method of claim 5 wherein step (a) and the soak period step are repeated for a plurality of cycles.

7. The method of claim 6 wherein the total amount of high temperature steam injected does not exceed 0.15 pore volume.

* * * * *